United States Patent [19]

Stone

[11] 4,365,717

[45] Dec. 28, 1982

[54] FEED APPARATUS AND METHOD

[75] Inventor: Alan M. Stone, Victoria, Australia

[73] Assignee: Sphere Investments Limited, Nassau, The Bahamas

[21] Appl. No.: 308,592

[22] Filed: Oct. 5, 1981

Related U.S. Application Data

[63] Continuation of Ser. No. 218,463, Dec. 22, 1980, abandoned, which is a continuation of Ser. No. 24,776, Mar. 28, 1979, abandoned.

[30] Foreign Application Priority Data

Apr. 24, 1978 [ZA] South Africa ..... 78/2327
Jun. 7, 1978 [ZA] South Africa ..... 78/3250

[51] Int. Cl.[3] ..... B07C 5/02
[52] U.S. Cl. ..... 209/539; 198/445; 198/603
[58] Field of Search ..... 198/383, 404, 434, 438, 198/443, 445, 446, 603, 607, 638, 821; 209/539, 639, 642

[56] References Cited

U.S. PATENT DOCUMENTS

| | | | |
|---|---|---|---|
| 2,456,031 | 12/1948 | Spain | 198/446 |
| 2,558,899 | 7/1951 | Green | 198/383 |
| 2,799,385 | 7/1957 | Peek | 198/404 |
| 2,923,138 | 2/1960 | Rollins | 198/603 |
| 3,161,485 | 12/1964 | Buhrer | 198/603 |
| 4,074,807 | 2/1978 | Goulds | 198/445 |

*Primary Examiner*—Joseph E. Valenza
*Attorney, Agent, or Firm*—Cushman, Darby & Cushman

[57] ABSTRACT

Feed apparatus and method for feeding objects such as ore rocks in such a way that they are arranged into at least one moving stream of spaced apart objects. The objects are fed onto a first conveyor belt which may have longitudinal channels to arrange the objects into moving rows. The moving objects are projected from end of the belt in free flight path and caught on downwardly moving section of a second belt which passes to a horizontal run via a concavely curved belt section so that objects are stabilized on the second belt by centrifugal action to emerge on horizontal run as one or more fast moving streams.

5 Claims, 3 Drawing Figures

FEED APPARATUS AND METHOD

This is a continuation of application Ser. No. 218,463 filed Dec. 22, 1980, now abandoned, which was a continuation of application Ser. No. 24,776 filed Mar. 28, 1979, now abandoned.

BACKGROUND OF THE INVENTION

This invention provides a feed apparatus and method for feeding objects in such a way that they are arranged into one or more moving streams. The invention is particularly, but not exclusively, applicable to the feeding of objects in ore sorting equipment.

In a known type of ore sorting equipment, ore rocks must be presented to scanning apparatus in one or more moving streams in which the individual rocks are spaced apart. The scanning apparatus determines the characteristic of the individual objects which are then sorted according to those characteristics while moving in the streams. In such equipment the speed and relative disposition of the rocks in the various streams must not vary and the speed of the rocks must be quite high in order to achieve high sorting rates. Various means have been proposed for depositing the rocks on a fast moving feed belt but difficulties have been experienced in achieving satisfactory spacing between successive rocks and in stabilizing the rocks so that they do not move about on the belt. The present invention has enabled these difficulties to be overcome.

SUMMARY OF THE INVENTION

The invention provides feed apparatus for feeding objects in such a way that they are arranged into at least one moving stream of spaced apart objects, comprising:

an endless conveyor belt;

conveyor belt support means supporting the conveyor belt in a closed loop having an upright run and a substantially horizontal run interconnected by an arcuate run;

belt drive means to drive the belt conveyor such that the belt moves downwardly through the upright run and around the arcuate run and thence along the substantially horizontal run; and feed means operable to form a moving primary stream of objects and to project those objects in a free flight trajectory onto the upright run of the conveyor belt so as to be carried via the arcuate run onto the substantially horizontal run as a secondary stream of spaced apart objects and so as to be stabilized on the belt by centrifugal action as they are carried around the arcuate run.

Preferably, said feed means comprises:

a further endless conveyor belt;

further belt support means supporting the further conveyor belt in a closed loop having an object feeding run disposed above the generally horizontal run of the first-said conveyor belt;

further belt drive means to drive the further belt such that it moves through said object feeding run in a direction generally opposite to the direction of movement of the first-said conveyor belt through its horizontal run; and means to deposit objects onto the object feeding run of the further conveyor belt whereby, in operation of the apparatus, said primary stream of objects is formed on the object feeding run of the further conveyor belt and the objects are projected from the end of said object feeding run of the further conveyor belt into said free flight path to impinge on the first-said conveyor belt.

The invention also provides a method for feeding objects in such a way that they are arranged into at least one moving stream of spaced apart objects comprising forming at least one primary stream of objects on a first moving support surface;

projecting the objects in said primary stream from the first moving support surface and allowing the projected objects to move in free flight so as to be accelerated downwardly by gravity whereby to increase their spacing in the direction of movement;

catching the projected objects on a second support surface; and carrying the objects on said second moving support surface as a secondary stream of spaced apart objects.

BRIEF DESCRIPTION OF THE DRAWINGS

The invention is further described by way of example with reference to the accompanying drawings in which.

DESCRIPTION OF A PREFERRED EMBODIMENT

Figure 1:
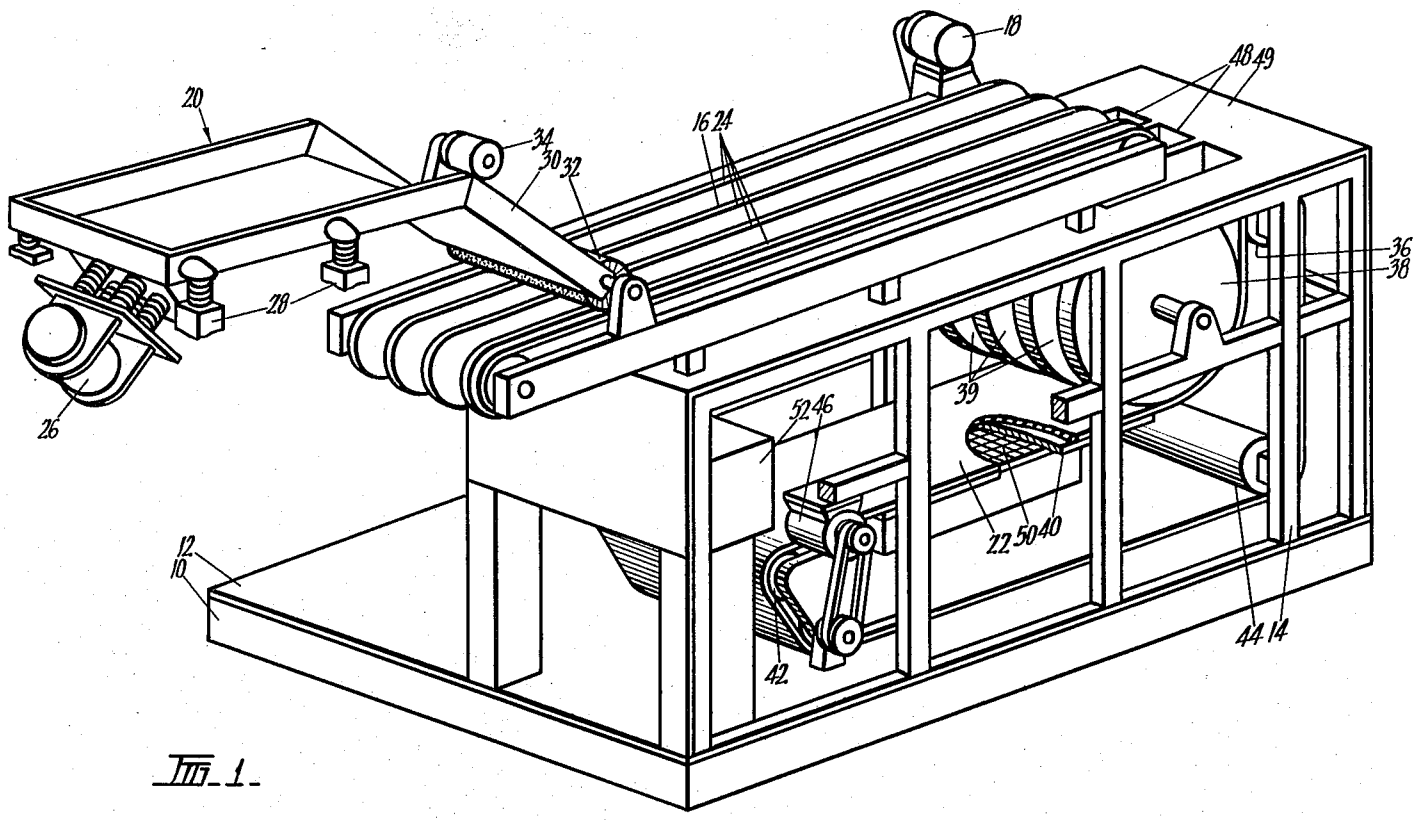
FIG. 1 is a perspective view of a feed apparatus according to the invention.
Figure 3:
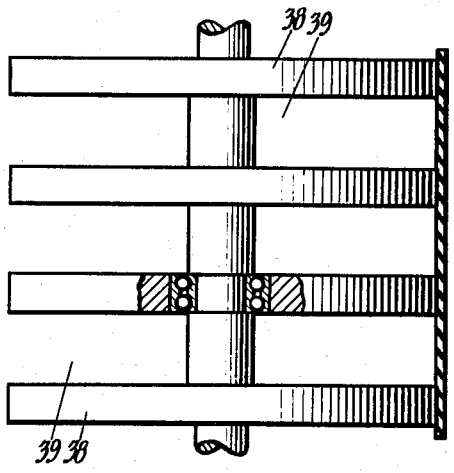
FIG. 3 is a cross-section on the line 3—3 in FIG. 2.
Figure 2:
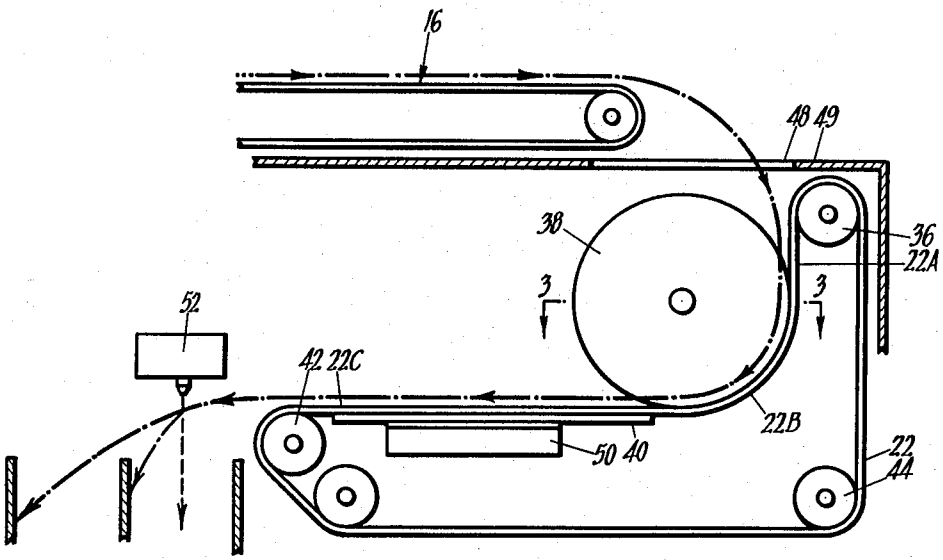
FIG. 2 is a diagrammatic vertical cross-section of that feed apparatus.

The feed apparatus shown in the drawings includes a support frame 10, a platform 12 on the support frame, a main frame 14 supported by the frame 10 and the platform 12, a conveyor belt 16 driven by a motor 18 attached on top of the main frame 14, a vibratory feeder 20 above the conveyor 16, and a second conveyor belt 22 supported by the main frame 14.

The conveyor belt 16 is channelized by means of a number of parallel ribs 24 on its outer surface.

The vibratory feeder 20 is driven by means of a motor 26 and is mounted on feeder supports 28. The feeder discharges onto a chute 30. A brush 32 which is rotated by means of a motor 34 is located at the discharge end of the chute.

The second conveyor belt 22 passes over a take-up pulley 36, around a series of laterally spaced stabilizer pulleys 38, over a slide plate 40, around a head pulley 42 and around a tail pulley 44. The head pulley 42 is driven by means of a motor 46.

The second conveyor belt 22 thus travels along a substantially L-shaped path. The path includes a short vertical run 22A between the take-up pulley 36and the stabilizer pulleys 38, an arcuate run 22B defined by the stabilizer pulleys, and a horizontal run 22C downstream from the stabilizer pulleys.

The spaces between the stabilizer pulleys 38 constitute a series of parallel channels 39 around the arcuate run of belt 22 and these channels are aligned with the channels in the belt 16 formed by the ribs 24. Feed slots 48 are formed in a table surface 49 at the discharge end of belt 16 and these are also aligned with the channels in belt 16 so that objects can be projected from those channels and through slots 48 onto belt 22.

Suitable scanning apparatus 50 is provided beneath the slide plate 40 and selection apparatus 52 is located slightly above the discharge end of the second conveyor 22. The nature of the scanning apparatus 50 and the selection apparatus 52 is not important to the understanding of the present invention and will not be further described here save for mentioning that the scanning apparatus may for example consist of one or more scintillation counters and the selection apparatus of air ejector nozzles.

In use of the feed apparatus the objects which are to be sorted are deposited on the feeder 20 by means of a hopper, not shown, and are then vibrated onto the discharge chute 30. The objects tumble down the chute and pass under rotating brush 32 onto the belt 16. The feeding rate of the vibratory feeder 20 and the speed of the belt 16 are so adjusted that the objects which fall onto the belt lie very close to one another but in a single layer and in rows defined by the channels of the belt. The objects are carried to the right in the drawings by the belt and are projected from the end of the belt to pass in free flight in downwardly curving paths through the feed slots 48. The belt 16 can be vibrated, for example by the use of an eccentric drive pulley, to facilitate the alignment of the object into the rows defined by the channels of the belt.

When the objects leave the belt 16 they are accelerated by the force of gravity and consequently separate from one another. The objects move in an arc away from their departure points through the feed chutes 48 and impinge on the short vertical downwardly moving run 22A of the second conveyor belt 22 in the vicinity of the junction of that run with the arcuate run 22B. On coming into contact with the vertical belt run 22A the objects are moving downwardly at a speed which is substantially equal to the belt speed. They will also have a horizontal component of movement forcing them onto the belt.

The objects projected from belt 16 and caught on the vertical run 22A of belt 22 are carried downwardly around the arcuate belt run 22B within the channels 39 between the stabilizer pulleys and are thus stabilized by centrifugal force to emerge on the horizontal run of the belt above the scanning apparatus 50 in stable parallel streams and spaced from each other. The separation of the objects is dependent on the speeds of the two conveyor belts 16 and 22, and the horizontal and vertical spacing between the discharge end of belt 16 and the vertical run 22A and horizontal run 22B of the belt 22. The stability of the objects is further increased because oscillations or vibrations of the belt over the horizontal stage are minimized since the belt rides on the slide plate 40. This means that when the objects are presented to the scanning apparatus they are steady and an accurate assessment of the characteristics is made.

The characteristics of the objects are determined by the scanning apparatus 50 and by the time the objects reach the discharge end of the second conveyor a decision has been made as to their suitability. If the objects are selected the selection apparatus 52 is activated and the objects are blasted downwardly by compressed air while in free flight after leaving the second belt 22. Unselected objects are not blasted by compressed air and are allowed to travel freely into a collecting bin, not shown.

The invention thus provides apparatus which is capable of handling objects at a high rate and with adequate stability. The capacity of the apparatus can be increased by extending the width of the conveyor belts and ancillary equipment.

The spacing between the objects on the horizontal section of the belt 22 is dependent inter alia on the relative speeds of the two belts. To increase the spacing the speed of the lower belt 22 can be increased, or the speed of the upper belt 16 can be decreased. The speeds of the belts can easily be controlled by varying the speeds of the motors 18 and 46.

The height of the belt 16 above the centre line of the stabilizer discs is a function of the speed of belt 22, such that the speed of an object leaving belt 16 is substantially matched to the speed of belt 22 when it makes contact with belt 22. The horizontal spacing between the discharge end of the belt 16 and the vertical run of the belt 22 may have to be increased for relatively larger objects and may be catered for by mounting the belt 16 on a suitable adjustable support.

It is important to proper operation of the apparatus that the objects projected from belt 16 should, if correctly positioned, be able to pass in unimpeded free flight onto belt 22 and slots 48 must be large enough to permit this. Similarly, the objects will normally pass through the channels 39 without engaging the stabilizer pulleys. However, there may occasionally be stray objects and the slots 48 and channels 39 thus serve to confine such stray objects within the defined streams. The side walls of slots 48 may be extended downwardly toward the stabilizer pulley channels in chute-like formations to ensure that stray rocks cannot possibly enter the nips between the belt 22 and the stabilizer pulleys.

I claim:

1. Feed apparatus for feeding objects in such a way that they are arranged into at least one moving stream of spaced apart objects, comprising an endless conveyor belt; conveyor belt support means supporting the conveyor belt in a closed loop having an upright run and a substantially horizontal run interconnected by an arcuate run; belt drive means to drive the conveyor belt such that the belt moves downwardly through the upright run and around the arcuate run and thence along the substantially horizontal run; and feed means operable to form a plurality of parallel primary streams of objects and to project those objects in a completely free flight trajectory onto the upright run of the conveyor belt so as to be carried via the arcuate run onto the substantially horizontal run as a plurality of parallel secondary streams of spaced apart objects and so as to be stabilized on the belt by centrifugal action as they are carried around the arcuate run, said feed means including a further endless conveyor belt having a plurality of parallel channels formed on the object-feeding surface thereof; further belt support means supporting the further conveyor belt in a closed loop having an object feeding run disposed above and extending longitudinally of the generally horizontal run of the first-said conveyor belt to a discharge end located generally above said arcuate run of the first-said conveyor belt; belt drive means to drive the further belt such that it moves through said object feeding run in a direction toward the discharge end of that run and opposite to the direction of movement of the first-said conveyor belt through its horizontal run; and means to deposit objects onto the object feeding run of the further conveyor belt whereby, in operation of the apparatus, said primary stream of objects is formed on the object feeding run of the further conveyor belt and the objects are projected from said discharge end of that run into a downwardly curving free flight trajectory and into contact with the upright run of the conveyor belt, in which the spacing of the objects is increased in the direction of movement due to downward gravitational acceleration and which brings them into smooth impingement with the downwardly moving upright run of the first-said conveyor belt.

2. Feed apparatus as claimed in claim 1, which includes a plurality of rotatable pulleys spaced across the belt and engaging the arcuate run of the first-said conveyor belt so as to stabilize the arcuate run and to define between said pulleys channel means for objects projected in free flight trajectory onto that belt.

3. An ore sorting apparatus including an endless belt; conveyor belt support means supporting the conveyor belt in a closed loop having an upright run and a substantially horizontal run interconnected by an arcuate run; belt drive means to drive the conveyor belt such that the belt moves downwardly through the upright run and around the arcuate run and thence along the substantially horizontal run; and feed means operable to form a plurality of parallel primary streams of objects and to project those objects in a completely free flight trajectory onto the upright run of the conveyor belt so as to be carried via the arcuate run onto the substantially horizontal run as a plurality of parallel secondary streams of spaced apart objects and so as to be stabilized on the belt by centrifugal action as they are carried around the arcuate run, said feed means including a further endless conveyor belt having a plurality of parallel channels formed on the object feeding surface thereof; further belt support means supporting the further conveyor belt in a closed loop having an object feeding run disposed above and extending longitudinally of the generally horizontal run of the first-said conveyor belt to a discharge end located generally above said arcuate run of the first-said conveyor belt; belt drive means to drive the further belt such that it moves through said object feeding run in a direction toward the discharge end of that run and opposite to the direction of movement of the first-said conveyor belt through its horizontal run; and means to deposit objects onto the object feeding run of the further conveyor belt whereby, in operation of the apparatus, said primary stream of objects is formed on the object feeding run of the further conveyor belt and the objects are projected from said discharge end of that run into a downwardly curving free flight trajectory and into contact with the upright run of the conveyor belt in which the spacing of the objects is increased in the direction of movement due to downward gravitational acceleration and which brings them into smooth impingement with the downwardly moving upright run of the first-said conveyor belt.

4. An ore sorting apparatus according to claim 3 including scanning apparatus positioned beneath the horizontal run of the conveyor belt comprising scintillation counter means, and ore selection apparatus positioned adjacent a discharge end of said horizontal run.

5. A method for feeding objects in such a way that they are arranged into a plurality of primary moving streams of spaced apart objects comprising forming said primary streams of objects on a first moving support surface having a horizontal component of motion; projecting the objects in said primary stream from the first moving support surface and allowing the projected objects to move in a downwardly curving free flight trajectory in which they move unimpeded with a horizontal component of movement and are accelerated downwardly by gravity whereby to increase their spacing in the direction of movement; catching the projected objects on a second support surface by moving said second support surface downwardly in the path of said free flight trajectory such that the objects impinge smoothly on the second support surface; and carrying the objects on said second moving support surface through an arcuate path which curves against the direction of the horizontal component of movement of the objects in the free flight trajectory and thence along a straight path as a plurality of parallel secondary streams of spaced apart objects, whereby the objects are stabilized on the second support surface by centrifugal action during movement through said arcuate path.

* * * * *